US008296877B2

(12) United States Patent
Grossman et al.

(10) Patent No.: US 8,296,877 B2
(45) Date of Patent: Oct. 30, 2012

(54) FUTON WITH NESTING PLATFORM MEMBERS

(75) Inventors: Joel Grossman, Selangor (MY); Howard Porter, Kuala Lumpur (MY); Sin Keong Loo, Selangor (MY)

(73) Assignee: Grossman Product Services SDN. BHD., Kuala Lumpur (MY)

( * ) Notice: Subject to any disclaimer, the term of this patent is extended or adjusted under 35 U.S.C. 154(b) by 12 days.

(21) Appl. No.: 11/260,690

(22) Filed: Oct. 28, 2005

(65) Prior Publication Data

US 2007/0094789 A1 May 3, 2007

(51) Int. Cl.
*A47C 17/04* (2006.01)

(52) U.S. Cl. ..... 5/37.1; 5/47; 5/18.1

(58) Field of Classification Search ..... 5/37.1, 5/47, 18.1
See application file for complete search history.

(56) References Cited

U.S. PATENT DOCUMENTS

| | | | | |
|---|---|---|---|---|
| 5,392,475 | A * | 2/1995 | McCall et al. | 5/18.1 |
| 5,940,907 | A * | 8/1999 | Stoler et al. | 5/37.1 |
| 6,108,833 | A * | 8/2000 | Grossman et al. | 5/37.1 |
| 6,427,261 | B1 * | 8/2002 | Chadbourn | 5/18.1 |
| 6,725,473 | B2 * | 4/2004 | Grossman et al. | 5/37.1 |

* cited by examiner

*Primary Examiner* — William Kelleher
(74) *Attorney, Agent, or Firm* — Harness, Dickey & Pierce, P.L.C.

(57) ABSTRACT

A futon frame may include a seat platform and a back platform. The seat platform and the back platform may be nested together. The seat platform may have rails between which slats extend. The back platform having rails between which slats extend. A connector may be mounted on a rail of the seat platform to couple together the seat platform and the back platform in an assembled, non-nested condition. Recesses may be provided in two of the rails of the seat platform to accommodate a pair of stretcher rails.

28 Claims, 10 Drawing Sheets

FUTON WITH NESTING PLATFORM MEMBERS

BACKGROUND

1. Field of the Invention

The present invention relates in general to futons, and more particularly to a futon having platform members that may be nested together.

2. Description of Related Art

A futon frame may be packaged, for example, for transportation from a factory to an end user. In this regard, the futon frame may be a knocked-down and ready-to-assemble item intended for customer assembly. The futon packaging technique may take into account a couple of considerations. First, from a freight cost stand point, it may be desirable for the futon frame to be packaged efficiently (e.g., using a small carton or box, for example) for bulk transportation. Second, from the customer's stand point, it may be desirable for the futon frame to be easy to assemble.

These two considerations (e.g., efficient packaging versus ease of assembly) may be in conflict with each other. On the one hand, a small package with numerous loose parts and/or fasteners (e.g., screws, pins, nails, etc.) may result in more assembly work for the end user. On the other hand, a fully assembled frame may be shipped in a comparatively large package, and therefore may result in higher freight costs.

A futon frame may be packaged into two cartons or boxes, for example. A first box (or "arm box") may contain the arm portions (or side-panels) of the futon frame. A second box (or "body box") may contain platforms and connector rails (which connect the arm portions together).

The body box may contain a variety of frame platforms (e.g., a seat platform, a back platform, and/or an extension platform). Each of the frame platforms may include slats that sup port a futon mattress. The slats of the seat platform and the back platform may be of a uniform or substantially uniform length so that the seat and the back platforms may be of similar or substantially similar widths (e.g., taken in a longitudinal direction of the slats). As a result, the seat and the back platforms may not be arranged in a nesting fashion.

The back platform may have side rails that extend beyond the width of the back platform. These side rails may result in the body box having an extra space to accommodate these extended side rails. However, the space in the body box between the side rails may remain unoccupied. Thus, according to some conventional packaging techniques, the side rails of the back platform may be left off (and separately packaged) at the factory and prepared for customer assembly.

The seat platform may have a length (from side to side) that is shorter than the length of the back platform. Notwithstanding, the seat and back platforms may not be arranged in a nesting fashion, even if the side rails of the back platform are removed.

Furthermore, the seat and the back platforms may include under-slat supports, which may be (for example) 1"×2" strips of wood running along the length of the slat. Such under-slat supports may interfere with the nesting of the platforms.

In general, there are three types of packing techniques. In a first type, known as a Fully-Knocked Down (FKD) technique, the side rails of both the seat and the back platforms may be left off, and all the under-slat supports may be removed. In this condition, the seat and the back platforms may be nested. This may create the smallest carton size and therefore the lowest freight cost. However, the FKD technique leaves a significant amount of assembly work for the end user.

In a second type, known as a Partially-Assembled (PA) technique, only the side rails of the back platform are left off. This may reduce the overall width of the body box. The side rails of the seat platform are not left off so the two platforms will not nest. The PA technique saves only in the width of the body box, but it does not provide any advantage with respect to the height of the body box. As compared to the FKD technique, the PA technique requires less assembly work by the end user.

In a third type, known as a Fully-Assembled (FA) technique, all of the side rails of the seat and the back platforms and all under-slat supports are in-factory assembled, requiring no extra assembly by the end user. The FA technique creates the largest carton size and therefore the highest freight cost.

SUMMARY

According to an example, non-limiting embodiment, a futon frame may include a seat platform and a back platform. The seat platform may have four rails defining a region in which slats may be provided. The back platform may have four rails defining a region in which slats may be provided. The seat platform and the back platform may be nested.

According to another example, non-limiting embodiment, a futon frame may include a seat platform and a back platform. The seat platform may include rails and slats extending between the rails. The back platform may include rails and slats extending between the rails. At least one of the seat platform and the back platform may include slat supports extending along the slats. The seat platform and the back platform may be nested.

BRIEF DESCRIPTION OF THE DRAWINGS

The present invention will become more fully understood from the detailed description below and the accompanying drawings, wherein like elements are represented by like reference numerals, which are given by way of illustration only and thus are not limiting of the present invention.

DETAILED DESCRIPTION OF EXAMPLE, NON-LIMITING EMBODIMENTS

Figure 1:
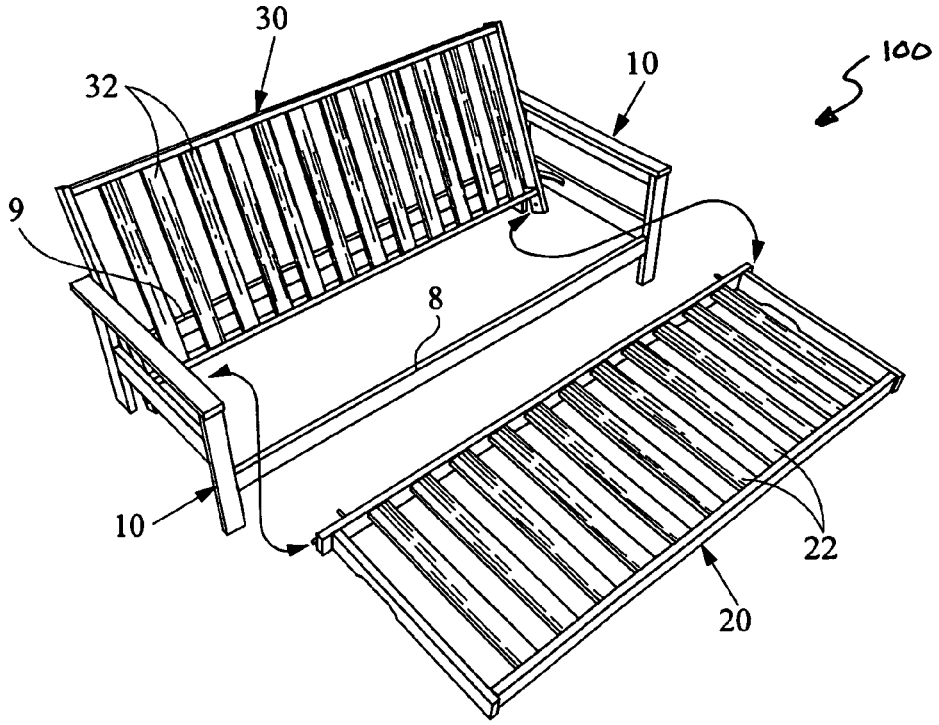
FIG. 1 is a perspective view of a futon frame according to an example, non-limiting embodiment of the invention.
Figure 2:
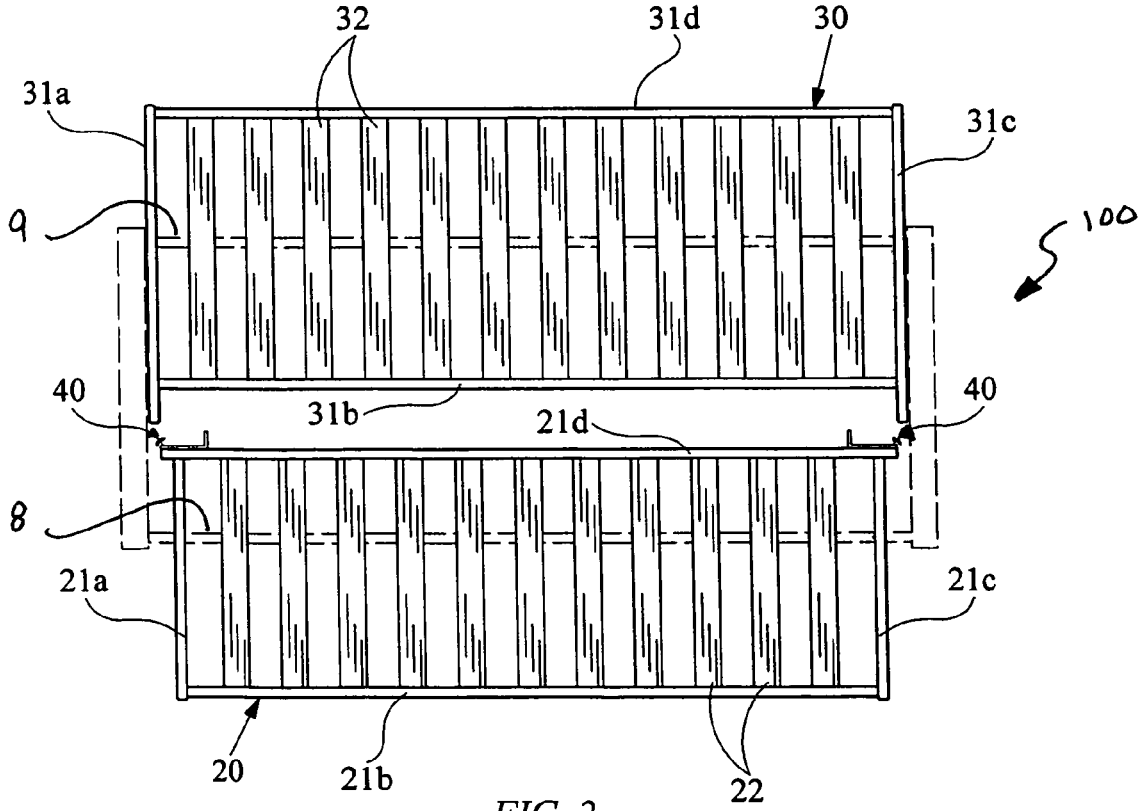
FIG. 2 is plan view of the futon frame illustrated in FIG. 1.
Figure 3:
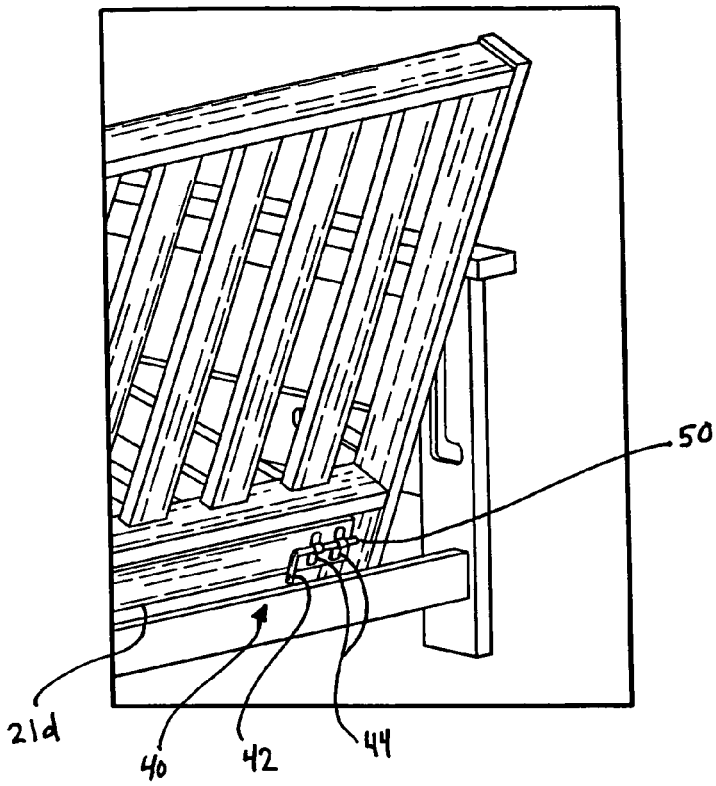
FIG. 3 is a partial perspective view of the futon frame illustrated in FIG. 1.
Figure 4:
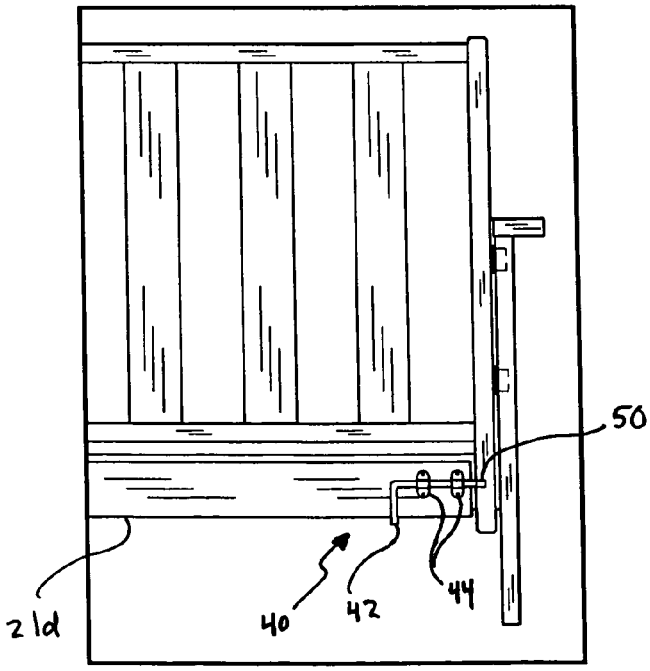
FIG. 4 is partial rear view of the futon frame illustrated in FIG. 1.
Figure 5:
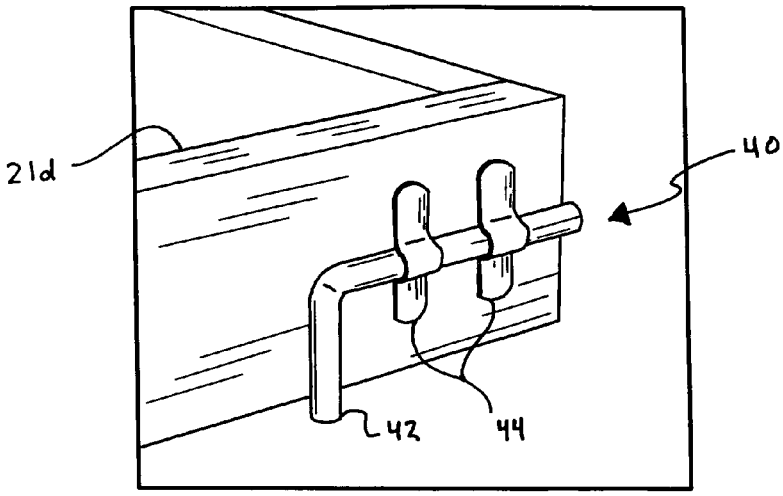
FIG. 5 is a partial perspective view of a connector according to an example, non-limiting embodiment of the invention.

I. The Futon Frame:

FIGS. 1 and 2 show a futon frame 100 in accordance with an example, non-limiting embodiment of the invention. The futon frame 100 may include arm portions 10 (or side panels), a seat platform 20 and a back platform 30. The arm portions 10 may be held together by a front stretcher rail 8 and a back stretcher rail 9. As shown, the arm portions 10 and the back stretcher rail 9 may support the back platform 30. The seat platform 20 is shown unattached and ready to assemble to the back platform 30.

The back platform 30 may have four rails, inclusive of two side rails 31*a* and 31*c*, a bottom rail 31*b* and a top rail 31*d*. The bottom and the top rails 31*b* and 31*d* may extend between and be connected to inward facing surfaces of the side rails 31*a* and 31*c* to define a region in which slats 32 are provided. The slats 32 may be spaced apart from each other and extend between and be connected to inward facing surfaces of the bottom and the top rails 31*b* and 31*d*.

The seat platform 20 may have four rails, inclusive of two side rails 21*a* and 21*c*, a front rail 21*b* and a back rail 21*d*. The front rail 21*b* may extend between and be connected to inward facing surfaces of the side rails 21*a* and 21*c*. The back rail 21*d* may be connected to longitudinal end surfaces of the side rails 21*a* and 21*c*. That is, the side rails 21*a* and 21*c* do not extend past the back rail 21*d*. The four rails 21*a-d* may define a region in which slats 22 are provided. The slats 22 may be spaced apart from each other and extend between and be connected to inward facing surfaces of the front and the back rails 21*b* and 21*d*.

The seat platform 20 and the back platform 30 may be connected together in numerous and varied ways. For example, a connector 40 may be mounted on the outward facing surface of the back rail 21*d*. By virtue of this outboard mounting location, the overall width (e.g., taken in a longitudinal direction of the slats 22) of the seat platform 20 may be decreased.

II. The Connector:

FIGS. 3-5, 8 and 10 show the functional and structural details of an example connector 40. In this example embodiment, the connector 40 may include a pin 42 that may be mounted on the back rail 21*d* via clamps 44. The pin 42 may be slidable relative to the clamps 44. In this way, the pin 42 may be slid relative to the clamps 44 and inserted into an aperture 50 respectively provided in each of the side rails 31*a* and 31*c* to connect together the seat and the back platforms 20 and 30. When connected together in this fashion, the seat platform 20 and the back platform may be rotatable relative to each other about the pin 42.

Figure 6:
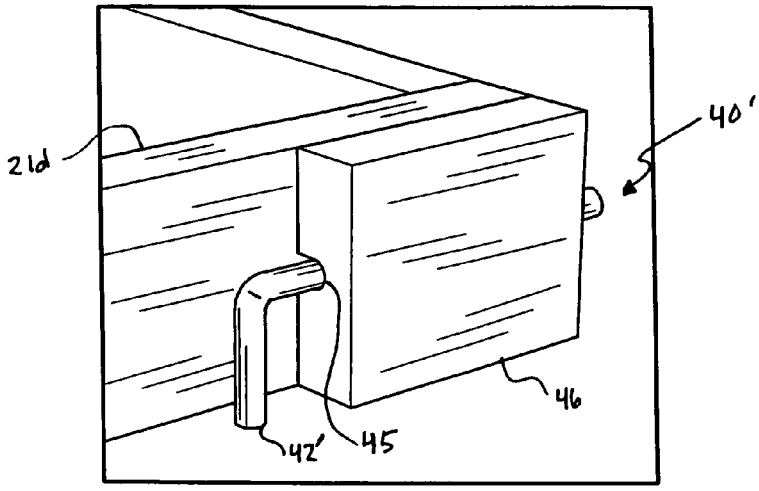
FIG. 6 is a partial perspective view of a connector according to another example, non-limiting embodiment of the invention.
Figure 7:
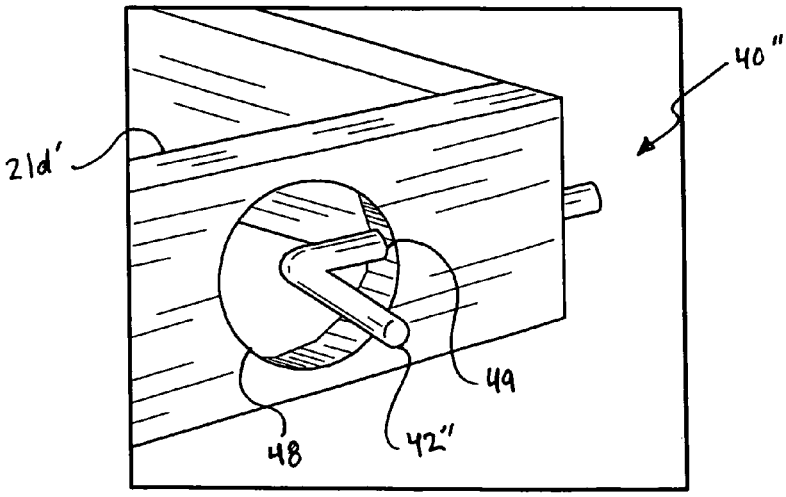
FIG. 7 is a partial perspective view of a connector according to another example, non-limiting embodiment of the invention.
Figure 8:
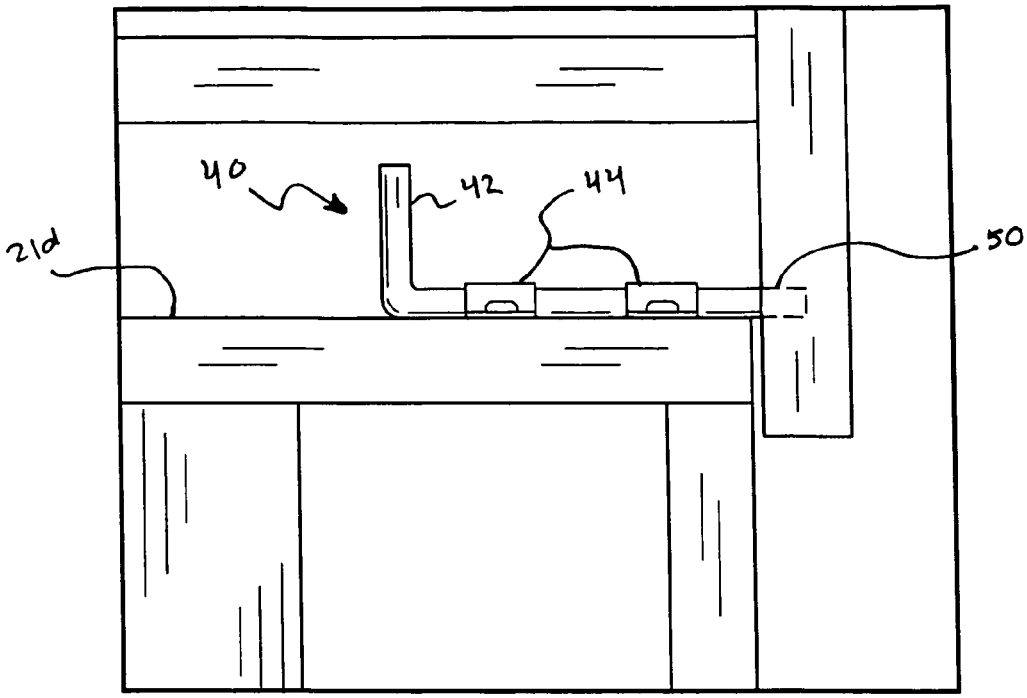
FIGS. 8 and 9 are partial plan views of the connector illustrated in FIG. 5 at varied mounting locations.

Alternative connectors, which may be suitably implemented, are illustrated in FIGS. 6 and 7. In FIG. 6, the connector 40' may include a pin 42' that may be mounted on the back rail 21*d* via a mounting block 46. The mounting block 46 may include a recess 45 in which the pin 42 is slidably mounted. In FIG. 7, the back rail 21*d'* of the seat platform may include an access hole 48. A bore 49 may extend from a side wall of the access hole 48 to a longitudinal end surface of the back rail 21*d'*. The connector 40" may include a pin 42" that is slidably mounted in the bore 49. The example connector 40" depicted in FIG. 7 may reduce the overall width (e.g., taken in a longitudinal direction of the slats 22) of the seat deck 20, as compared to the example connectors depicted in FIGS. 5 and 6.

Figure 9:
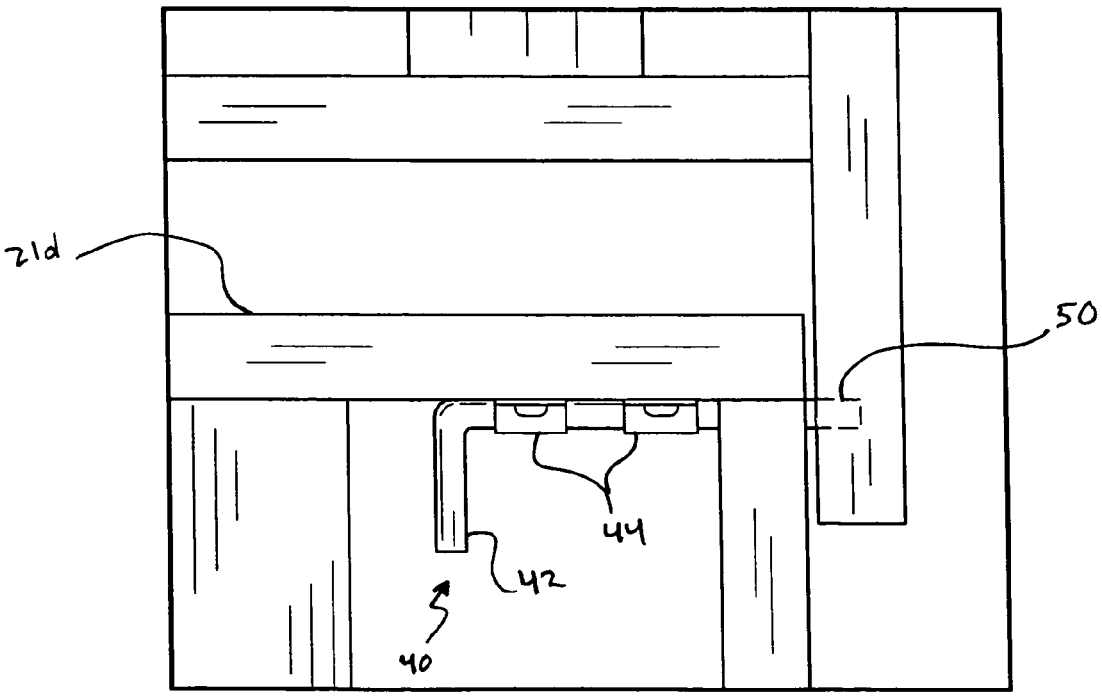
Figure 10:
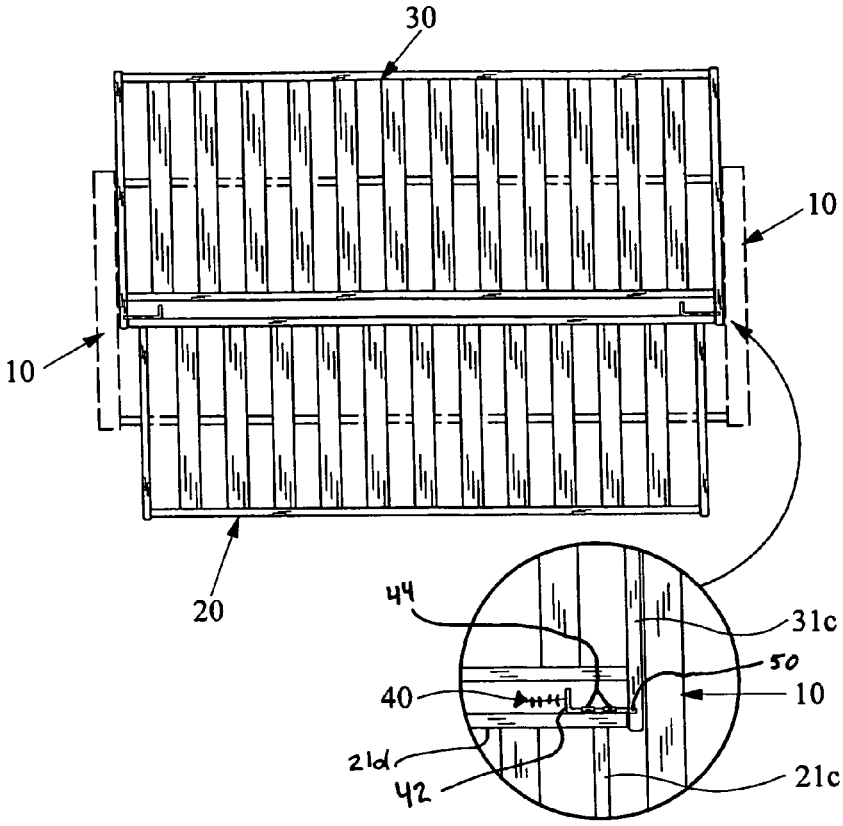
FIGS. 10 and 11 are plan view of the futon frame implementing the connectors illustrated in FIGS. 8 and 9, respectively.
Figure 11:
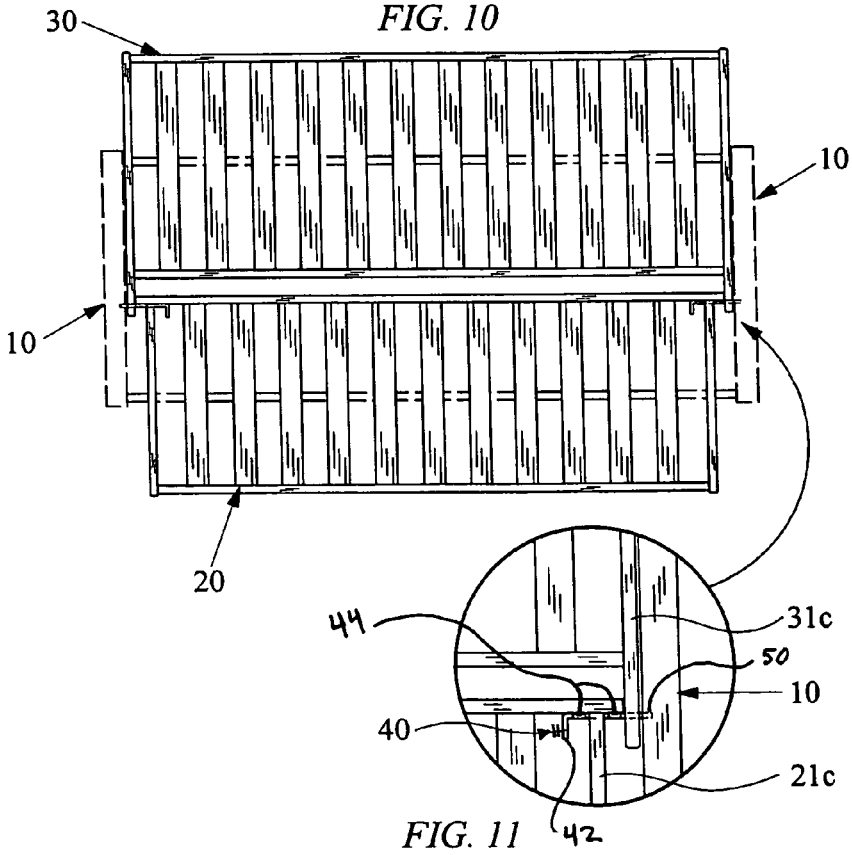

In addition, the connector 40 may be mounted on an inward facing surface of the back rail 21*d*, as shown in FIGS. 9 and 11. Here, the pin 42 may be mounted on the back rail 21*d* via clamps 44 that may be provided on opposed sides each of the side rails 21*a* and 21*c*. The pin 42 may extend through a bore provided in each of the side rails 21*a* and 21*c*. The pin 42 may be slidable relative to the clamps 44. In this way, the pin 42 may be slid relative to the clamps 44 and inserted into an aperture 50 respectively provided in each of the side rails 31*a* and 31*c* to connect together the seat and the back platforms 20 and 30. The connector's inboard mounting location may reduce the overall width (e.g., taken in a longitudinal direction of the slats 22) of the seat deck 20, as compared to the outboard connector mounting location depicted in FIGS. 5 and 6.

III. The "Nested" Feature:

The term "nested," as used in this specification, refers to the structure of at least two objects of graduated size that are stacked together, with a smaller object fitting within the immediate larger object. This definition has a few features. First, the smaller object and the larger object may be stacked together. Second, when stacked together, the smaller object may have an outer perimeter defining a smaller footprint that fits on a larger footprint defined by an outer perimeter of the larger object. That is, in plan view, the smaller object's footprint may not extend beyond the larger object's footprint. Third, when stacked together, at least a portion the larger object's outer boundary surface may overlap at least a portion of the smaller object's outer boundary surface.

Figure 12:
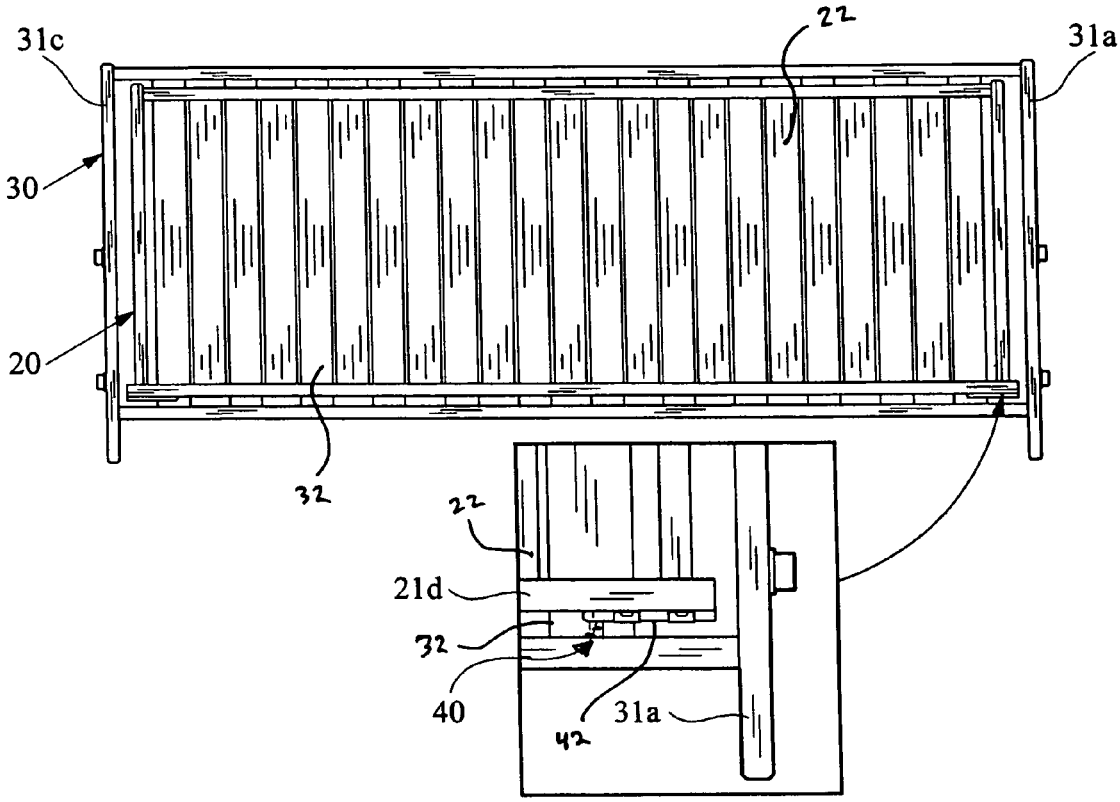
FIGS. 12 and 13 are schematic illustrations of the futon frame of FIG. 1 in a nested condition.
Figure 13:
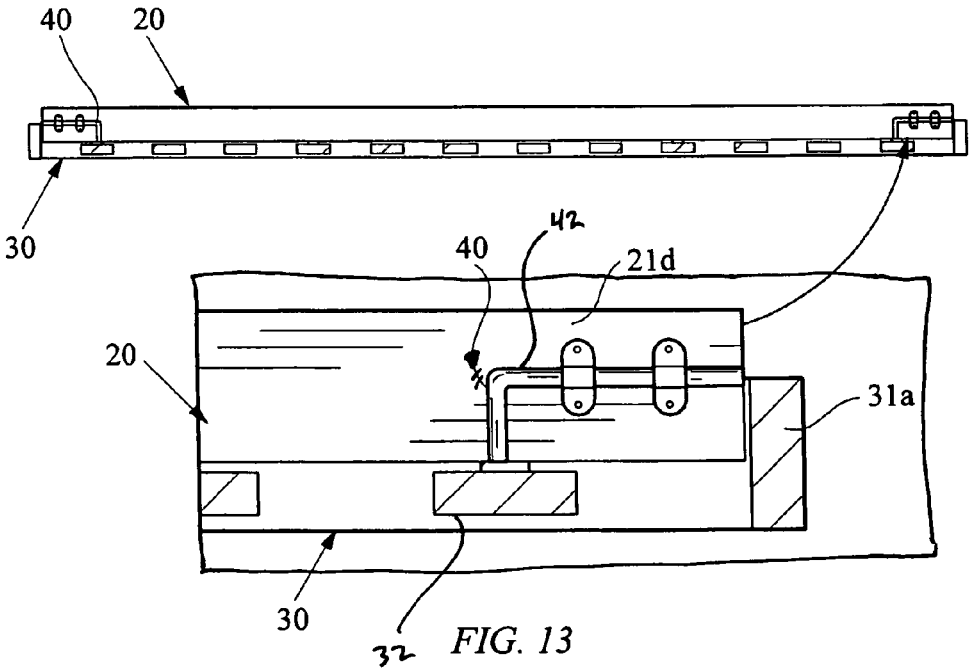

FIGS. 12 and 13 show the seat platform 20 nested into the back platform 30. Here, the pin 42 of the connector 40 may be retracted. As shown, the seat platform 20 may be stacked on top of the back platform 30. Further, all four assembled together rails 21*a-d* of the seat platform 20 (and the connector 40) define an outer perimeter that fits on a footprint defined by the outer perimeter of the four assembled together rails 31*a-d* of the back platform 30. Further, as clearly shown in FIG. 13, the outer boundary surfaces of the rails 31*a-d* of the back platform 30 overlap the outer boundary surfaces of the rails 21*a-d* of the seat platform 20. In this example embodiment, the four assembled together rails 31*a-d* of the back platform 30 extend all the way around (and overlap) the outer boundary surfaces of the assembled together rails 21*a-d* of the seat platform 20.

In the nested condition, the front rail 21*b* and the back rail 21*d* of the seat platform 20 may abut against the slats 32 of the back platform 30. The seat platform 20 and the back platform 30 may face in opposite directions. That is, the mattress supporting surfaces of the slats 22 (of the seat platform 20) may face away from the mattress supporting surfaces of the slats 32 (of the back platform 30). Further, as shown, the slats 22 of seat platform 20 may be off-set from the slats 32 of back platform 30. For example, in the plan view of FIG. 12, the slats 22 are not superimposed above the slats 32.

Figure 14:
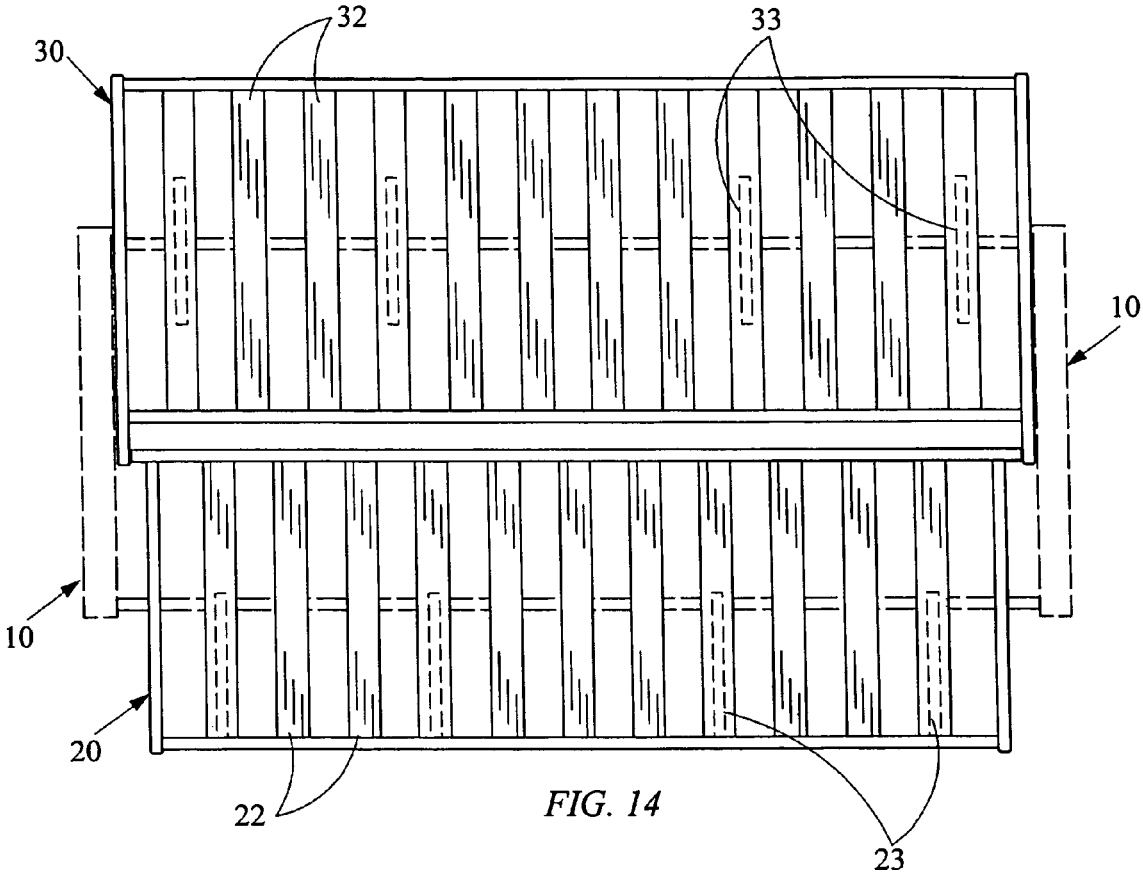
FIGS. 14 and 15 are schematic illustrations of a futon frame in accordance with another example, non-limiting embodiment of the invention.
Figure 15:
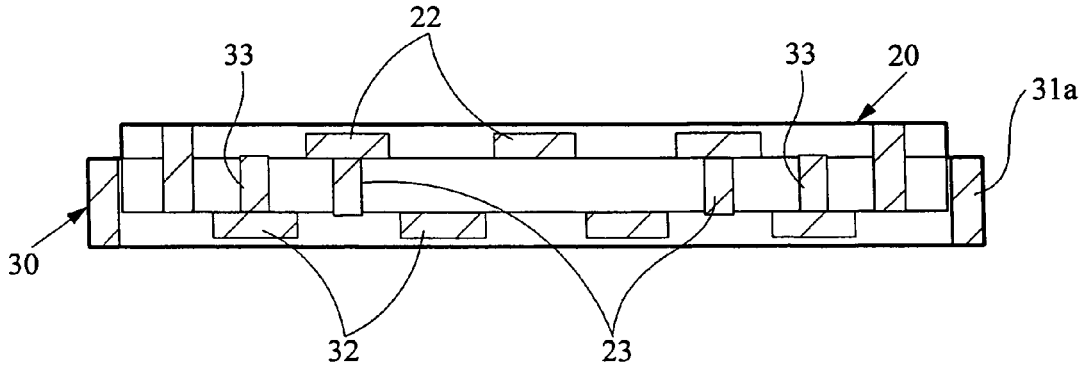

Turning to FIG. 14, the seat platform 20 may include slat supports 23 that extend along the slats 22, and the back platform 30 may include slat supports 33 that extend along the slats 32. As shown in FIG. 15, the off-set alignment of the slats 22 and 32 may allow the slat supports 23 of the seat platform 20 to clear and not touch the slat supports 33 of the back platform in the nested condition. Here, the slat supports 23 and 33 may occupy a region existing between the rails 31*a-d* of the back platform 30 and the rails 21*a-d* of the seat platform 20.

Figure 16:
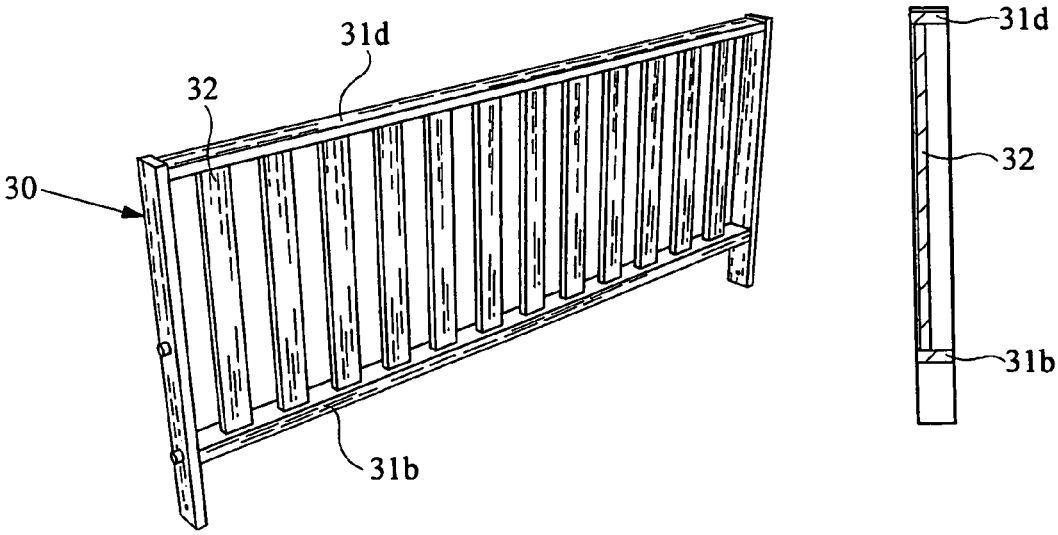
FIGS. 16-18 show the futon frame of FIG. 1 before and after being nested.
Figure 17:
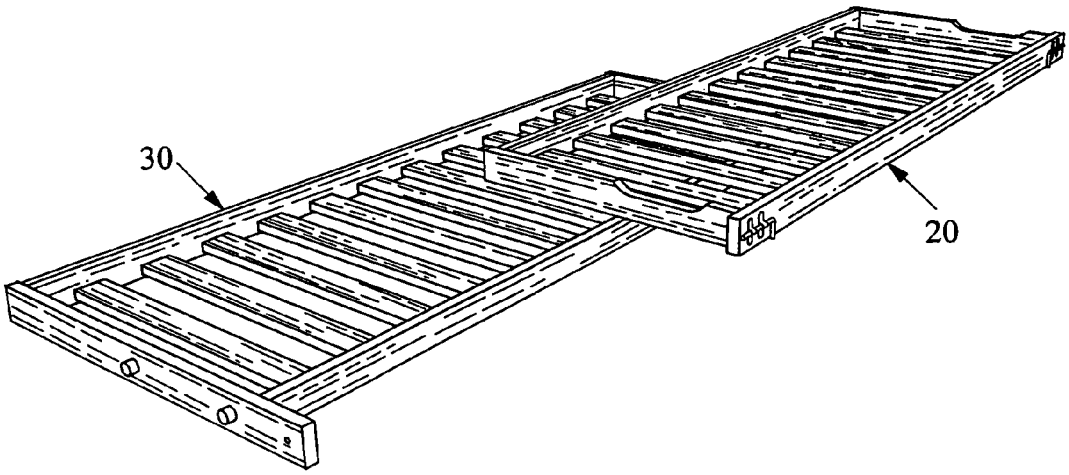
Figure 18:
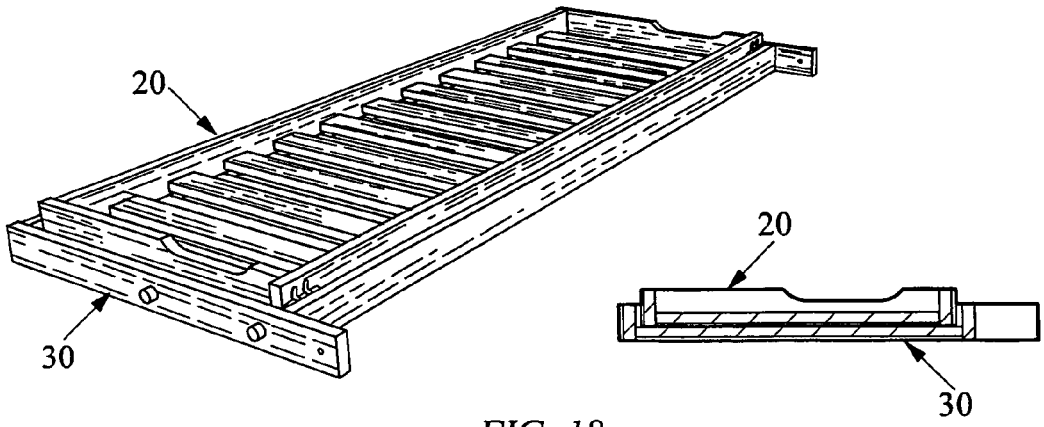

FIGS. 16 and 17 show the back platform 30 and seat platform 20 ready for nesting, and FIG. 18 shows seat platform 20 nested within the back platform 30.

Figure 19:
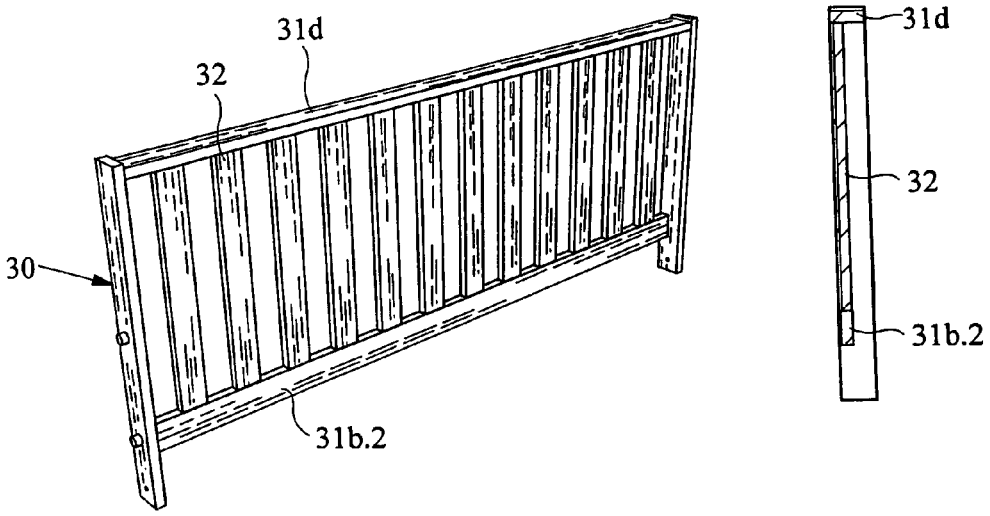
FIGS. 19-23 are schematic illustrations of a futon frame in accordance with another example, non-limiting embodiment of the invention.
Figure 20:
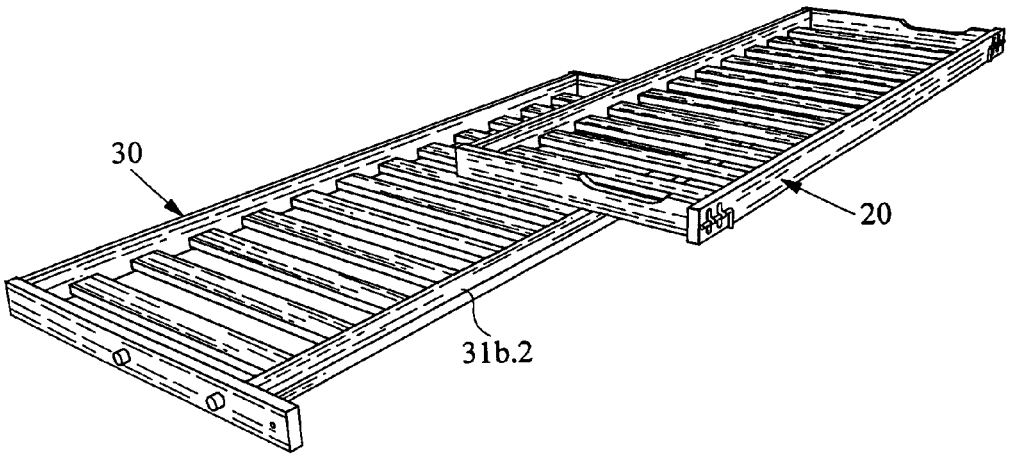
Figure 21:
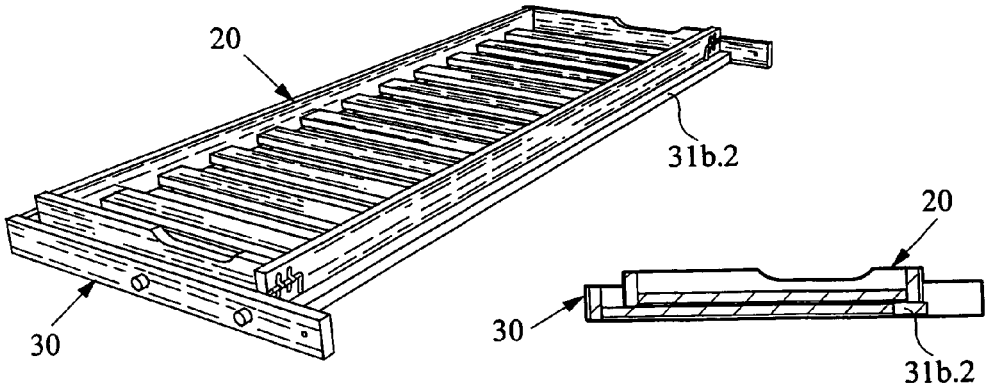

FIG. 19-21 show another example embodiment of the present invention. Here, the back platform 30 has a bottom rail 31*b*.2 that may be rotated 90° (as compared to the bottom rail 31*b* of the previous embodiment) and assembled in the same plane as the slats 32. As compared to the previous embodiment, this embodiment may provide additional room to accommodate the width of the seat platform 20.

FIG. 21 shows the seat platform 20 nested into the back platform 30. Here, all four assembled together rails of the seat platform 20 define an outer perimeter that fits on a footprint defined by the outer perimeter of the four assembled together rails of the back platform 30. In this embodiment, however, the outer boundary surfaces of only three of the rails of the back platform 30 overlap the outer boundary surfaces of three of the rails of the seat platform 20. The back rail of the seat platform 20 is arranged on top of the bottom rail 31*b*.2 of the back platform 30. Consequently, the outer boundary surface of the bottom rail 31*b*.2 does not overlap the outer boundary surface of the back rail of the seat platform 20. Notwithstanding, the seat platform 20 and the back platform 30 are considered to be nested, as defined in this specification.

Figure 22:
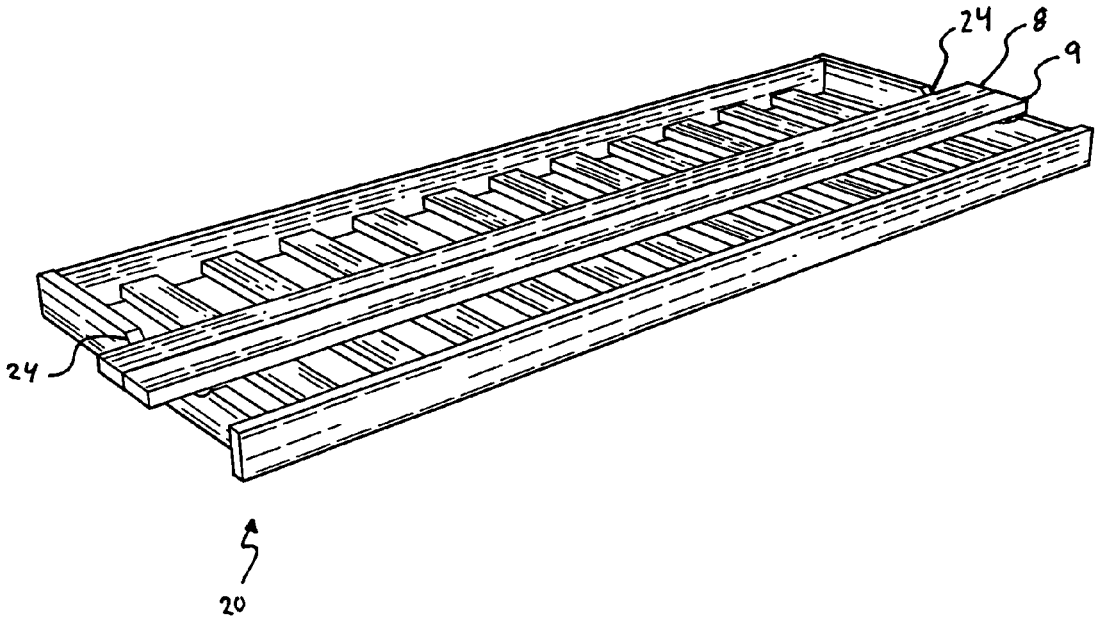
Figure 23:
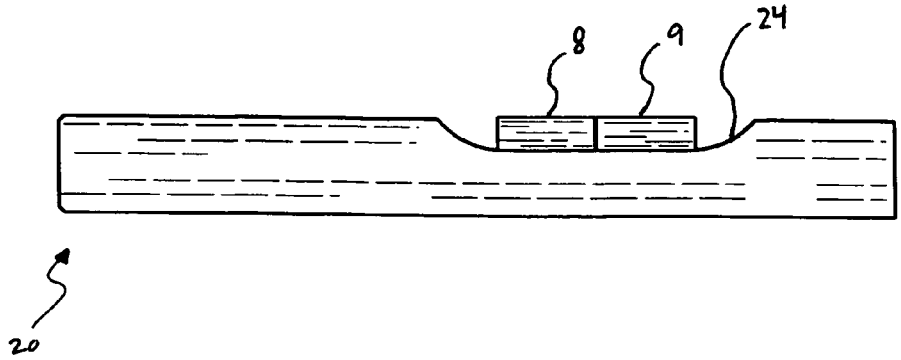

FIGS. 22 and 23 show a cut-away 24 that may be provided in each of the side rails of the seat platform 20. The cut-away 24 may provide a convenient location to pack the stretcher rails 8 and 9.

The above example embodiments of the invention, including various and novel details of construction and combination of parts, has been particularly described with reference to the accompanying drawings. It will be understood that the particular futon frames embodying the invention are shown by way of illustration only and not as a limitation. The principles and features of the disclosed embodiments may be employed in varied and numerous embodiments without departing from the scope of the invention, as defined by the appended claims.

For example, in the disclosed example embodiments, the seat platform is nested within the back platform. It will be appreciated, however, that the back platform may be nested within the seat platform. In addition, other frame components (e.g., a futon extension) may be nested within the stack of components. Finally, in the example embodiments, the seat platform and the back platform include four rails defining a closed region in which the slats may be provided. In alternative embodiments, the seat platform and/or the back platform may include a fewer number of rails. For example, the seat platform may include only the front and back rails, and no side rails.

What is claimed is:

1. A futon frame, comprising:

a first platform having a top rail, a bottom rail and side rails that define a first region in which first slats are provided; and a second platform having a top rail, a bottom rail and side rails that define a second region in which second slats are provided;

wherein the first platform and the second platform are moveable between an assembled condition, in which the first and second platforms are coupled together, and an unassembled condition, wherein the first slats extend between the top rail and the bottom rail of the first platform in a first direction to define a first plane, wherein the second slats extend between the top rail and the bottom rail of the second platform in a second direction to define a second plane;

wherein the bottom rail of the first platform is rotated 90° with respect to the top rail of the first platform such that the first slats are co-planar with the bottom rail of the first platform, wherein when stacked together in the unassembled condition, outer boundary surfaces of the four second rails of the second platform overlap outer boundary surfaces of the four first rails of the first platform so that the first platform fits entirely within a footprint defined by the second platform, with the first plane substantially parallel to the second plane, and wherein in the unassembled condition, an offset between the first and second slats, in a direction substantially parallel to the first and second planes and substantially perpendicular to the first and second directions, allows the first and second platforms to be stacked together so that the first slats do not contact the second slats.

2. The futon frame of claim 1, wherein in the assembled condition, the first and second platforms are configured to move to a substantially horizontal position, wherein in the assembled condition, a side of the first platform facing upward from the substantially horizontal position defines a face of the first platform, and an opposite side of the first platform defines a back of the first platform, wherein in the assembled condition, a side of the second platform facing upward from the substantially horizontal position defines a face of the second platform, and an opposite side of the second platform defines a back of the second platform, and wherein in the unassembled condition, the first and second platforms are configured to stack together with the backs of the first and second platforms facing each other.

3. The futon frame of claim 2, wherein the first platform includes at least one first slat support that extends along one of the first slats, wherein the at least one first slat support extends lengthwise along the one of the first slats such that the at least one first slat support is disposed generally within a footprint defined by the one of the first slats, wherein the second platform includes at least one second slat support that extends along one of the second slats, wherein the at least one second slat support extends lengthwise along the one of the second slats such that the at least one second slat support is disposed generally within a footprint defined by the one of the second slats, and wherein in the unassembled condition, when the first and second platforms are stacked together, the at least one first slat support does not touch the at least one second slat support.

4. The futon frame of claim 3, wherein when stacked together in the unassembled condition, the at least one first slat support and the at least one second slat support occupy a region existing between the first of the first platform and the second rails of the second platform.

5. The futon frame of claim 1, wherein the first platform includes at least one first slat support that extends along one of the first slats, wherein the at least one first slat support extends lengthwise along the one of the first slats such that the at least one first slat support is disposed generally within a footprint defined by the one of the first slats, wherein the second platform includes at least one second slat support that extends along one of the second slats, and wherein the at least one second slat support extends lengthwise along the one of the second slats such that the at least one second slat support is disposed generally within a footprint defined by the one of the second slats.

6. The futon frame of claim 1, wherein one of the rails of the first platform has a major surface that is perpendicular to a major surface of an opposed one of the first rails of the first platform.

7. The futon frame of claim 1, wherein the first platform is a seat platform, and wherein the second platform is a back platform.

8. The futon frame of claim 7, further comprising:

a connector mounted on one of the rails of the first platform;

wherein the connector couples together the first and second platforms in the assembled condition.

9. The futon frame of claim 7, wherein the side rails of the first fails-platform are connected to the bottom rail of the first platform;

wherein the connector includes a pin that is surface mounted on the bottom rail of the first platform, and wherein the pin is slidably accessible by a user from between the side rails of the first platform.

10. The futon frame of claim 8, wherein the connector comprises a pin mounted on an outboard surface of one of the rails of the first platform.

11. The futon frame of claim 8, wherein the connector comprises a pin mounted on an inboard surface of one of the first rails of the first platform.

12. The futon frame of claim 11, wherein the pin extends through a bore provided in one of the first rails of the first platform.

13. The futon frame of claim 8, wherein the connector includes a pin extending through a bore provided in one of the first rails of the first platform.

14. The futon frame of claim 8, wherein the connector is mounted on the bottom rail of the first platform.

15. The futon frame of claim 8, wherein the connector includes a pin slidably mounted on one of the rails of the first platform.

16. The futon frame of claim 7, wherein recesses are provided in two opposed rails of the first platform, and wherein the recesses of the two opposed rails of the first platform accommodate a pair of stretcher rails.

17. The futon frame of claim 1, wherein the first platform is a back platform, and wherein the second platform is a seat platform.

18. The futon frame of claim 1, wherein a length of the first platform is less than a length of the second platform, and wherein a width of the first platform is less than a width of the second platform.

19. The futon frame of claim 1, further comprising a connector mounted on one of the rails of the first platform, the connector being a pin.

20. The futon frame of claim 19, wherein the pin is mounted on a back facing surface of the bottom rail via clamps.

21. The futon frame of claim 20, wherein the pin is slidable relative to the clamps and inserted into an aperture provided in one of the rails of the second platform.

22. The futon frame of claim 19, wherein the pin is mounted on an inward facing surface of the bottom rail via clamps.

23. The futon frame of claim 1, further comprising:

a connector mounted on the bottom rail of the first platform.

24. The futon frame of claim 23, wherein the connector comprises a pin mounted on an outboard surface of the bottom rail of the first platform.

25. The futon frame of claim 23, wherein the connector comprises a pin mounted on an inboard surface of the bottom rail of the first platform.

26. The futon frame of claim 25, wherein the pin extends through a bore provided in one of the side rails of the first platform.

27. A futon frame, comprising:

a first platform, including:

a top rail, a bottom rail and side rails; and first slats extending between the top rail and the bottom rail in a first direction to define a first plane; and a second platform, including:

a top rail, a bottom rail and side rails; and second slats extending between the top rail and the bottom rail in a second direction to define a second plane;

wherein the bottom rail of the first platform is rotated 90° with respect to the top rail of the first platform such that the first slats are co-planar with the bottom rail of the first platform, wherein the first platform includes at least one slat support extending along a respective first slat, the second platform includes at least one slat support extending along a respective second slat, or the first platform includes at least one slat support extending along the respective first slat and the second platform includes at least one slat support extending along the respective second slat, wherein the at least one slat support extends lengthwise along the respective first slat, second slat, or first and second slats such that the at least one slat support is disposed generally within a footprint defined by the respective first slat, second slat, or first and second slats, wherein the first and second platforms are moveable between an assembled condition and an unassembled condition, wherein when stacked together in the unassembled condition, outer boundary surfaces of the second rails of the second platform overlap outer boundary surfaces of the first rails of the first platform so that the first platform fits entirely within a footprint defined by the second platform, with the first plane substantially parallel to the second plane, and wherein in the unassembled condition, an offset between the first and second slats, in a direction substantially parallel to the first and second planes and substantially perpendicular to the first and second directions, allows the first and second platforms to be stacked together so that the first slats do not contact the second slats.

28. The futon frame of claim 27, wherein the first platform includes at least one slat support extending along one of the first slats, and wherein the second platform includes at least one slat support extending along one of the second slats.

* * * * *